US012715549B2

(12) United States Patent
Kalve et al.

(10) Patent No.: US 12,715,549 B2
(45) Date of Patent: Aug. 25, 2026

(54) EXTENDABLE DAVIT ARRANGEMENT

(71) Applicant: Vestdavit Gruppen AS, Laksevåg (NO)

(72) Inventors: Atle Kalve, Hordvik (NO); Vikaskumar Patel, Nyborg (NO)

(73) Assignee: Vestdavit Gruppen AS, Laksevåg (NO)

( * ) Notice: Subject to any disclaimer, the term of this patent is extended or adjusted under 35 U.S.C. 154(b) by 503 days.

(21) Appl. No.: 18/276,969

(22) PCT Filed: Feb. 11, 2022

(86) PCT No.: PCT/EP2022/053370
§ 371 (c)(1),
(2) Date: Aug. 11, 2023

(87) PCT Pub. No.: WO2022/171797
PCT Pub. Date: Aug. 18, 2022

(65) Prior Publication Data

US 2024/0124100 A1 Apr. 18, 2024

(30) Foreign Application Priority Data

Feb. 12, 2021 (NO) ..... 20210184
Apr. 19, 2021 (NO) ..... 20210491

(51) Int. Cl.
*B63B 23/26* (2006.01)

(52) U.S. Cl.
CPC ..... *B63B 23/26* (2013.01)

(58) Field of Classification Search
CPC ..... B63B 23/00; B63B 23/02; B63B 23/26; B63B 35/00; B63B 35/40; B63B 13/005; B63B 13/02; B66C 11/08
(Continued)

(56) References Cited

U.S. PATENT DOCUMENTS 3,778,855 A * 12/1973 Kariagin ..... B63B 23/26 212/292
4,364,326 A * 12/1982 Pike ..... B63B 23/62 114/372

(Continued)

FOREIGN PATENT DOCUMENTS

CN 101786489 A 7/2010
CN 102464089 A 5/2012

(Continued)

OTHER PUBLICATIONS

Patent Cooperation Treaty, International Application No. PCT/EP2022/053370, International Search Report, mailed Jun. 13, 2022, 2 pages.

(Continued)

*Primary Examiner* — Daniel V Venne
(74) *Attorney, Agent, or Firm* — Bradley Arant Boult Cummings LLP

(57) ABSTRACT

The invention relates to a davit arrangement (1, 20) arranged suspended over one or more boats or cargo devices (B, C) onboard a ship or similar vessel for launching or storing the one or more boats or cargo devices (B, C), the davit arrangement (1, 20) comprises a davit housing (19) having telescopically displaceable davit arm (3, 4, 5) and a hoisting arrangement (6) for hoisting and lowering the one or more boats or cargo device (B, C). The davit arrangement comprises a carrier (2) slidable connected to the davit arm (3, 4, 5), the hoisting arrangement (6) being further connected to the carrier (2), the davit housing (19) is connected to a turntable (10) for rotational movement of the davit arrangement (1, 20) around a center axis (A), the carrier (2) is adapted to be retracted to an innermost position where the hoisting arrangement (6) is aligned with the center axis (A) of the turntable (10). The invention further relates to a
(Continued)

method for transporting a boat or a cargo device (B, C) using the davit arrangement and a davit arrangement system.

14 Claims, 12 Drawing Sheets

(58) Field of Classification Search
USPC ..... 114/365, 368, 369, 370; 414/137.1
See application file for complete search history.

(56) References Cited

U.S. PATENT DOCUMENTS

| | | | | |
|---|---|---|---|---|
| 4,406,244 | A * | 9/1983 | Buchan | B63B 23/34 114/368 |
| 6,626,126 | B1 * | 9/2003 | Kalve | B63B 23/26 114/368 |
| 6,672,242 | B2 * | 1/2004 | Webb | B63B 23/10 114/368 |
| 8,813,549 | B1 * | 8/2014 | Pao | B63B 23/58 114/365 |

FOREIGN PATENT DOCUMENTS

| | | | |
|---|---|---|---|
| CN | 206797653 | U | 12/2017 |
| CN | 208053576 | U | 11/2018 |
| JP | S51100590 | A | 9/1976 |
| JP | H10250682 | A | 9/1998 |
| JP | 2006281887 | A | 10/2006 |
| KR | 101833987 | B1 | 3/2018 |
| KR | 101880730 | B1 | 7/2018 |
| NO | 311249 | B1 | 11/2001 |
| NO | 325214 | B1 | 2/2008 |
| WO | WO-9910229 | A1 | 3/1999 |

OTHER PUBLICATIONS

Nesse, Alexander et al., U.S. Appl. No. 18/276,990, Applicant Vestdavit Gruppen AS, filed Aug. 11, 2023.

* cited by examiner

EXTENDABLE DAVIT ARRANGEMENT

TECHNICAL FIELD

The present invention relates to a davit arrangement with a telescopically displaceable davit arm, which is arranged suspended over an associated boat or cargo for movement of the boat or cargo from a storing position to a launching position or vice versa. In particular, the invention relates to a davit arrangement with a carrier to positioning a hoisting device for lowering and hoisting of the boat or cargo.

The invention further relates to a method for transporting a boat or cargo using the davit arrangement.

BACKGROUND ART

The known davit arrangements are arranged suspended over an associated boat or cargo at a height substantially above the deck of the ship, so that it is possible to secure a relatively free deck space under the davit device.

The known davit devices have further a hoisting device that is extendable in a telescope part by a carrier arm that may be moved in a groove in a stationary secured telescope part.

The known davit devices however have a fixed position for the hoisting device so that when lifted, the boat or cargo is unable to be moved either at a center position of a davit arrangement or to a position at the end point of a davit arm. The known davit arrangements have thus a restricted moving area for the boat or cargo to the moved.

The invention provides an arrangement and method for easy launching or storage of a boat or cargo device by using a fully in-reach and outreach of the davit arm.

The arrangement may further reduce the steps from hoisting to storing or vice versa by directly position or retrieve the boat from the storage area before/after launching.

The arrangement may further be compact by requiring minimal space for the rotational movement of the davit arrangement for the reposition the davit arrangement from launching/storage to storage/launching position.

SUMMARY OF INVENTION

The invention relates to a davit arrangement arranged suspended over one or more boats or cargo devices onboard a ship or similar vessel for launching or storing the one or more boats or cargo devices, the davit arrangement comprises a davit housing having a telescopically displaceable davit arm and a hoisting arrangement for hoisting and lowering the one or more boats or cargo device. The invention being distinctive in that the davit arrangement comprises a carrier slidable connected to the davit arm, the hoisting arrangement being further connected to the carrier, the davit housing is connected to a turntable for rotational movement of the davit arrangement around a center axis, the carrier is adapted to be retracted to an innermost position where the hoisting arrangement is aligned with the center axis of the turntable.

The movement of the carrier with hoisting arrangement makes the davit arrangement accessible for hoisting and lowering in its full reach. The carrier is fixedly attached to the carrier and is moved within the davit arm for an optimal position for hoisting and lowering a boat or cargo.

By connecting the davit arrangement to the overhanging structure via a turntable, the davit arrangement may operate in a compact area.

Together with the fully in-reach position, the davit arrangement is able to rotate the wire around its own axis, i.e. the axis A. This requires a minimum of space when the opposite handling of the boat or cargo (i.e. lowering or hoisting) is to be performed in a different angle.

It is thus possible to perform the rotation of the davit arrangement to a different angle without the necessity to lower the boat or cargo as an intermediate step.

The procedure may thus be performed with only one hoisting procedure and one launching procedure. There is no need for an intermediate hoisting and lowering for the rotation of the davit arrangement.

Preferably, the carrier is adapted to be slidable moved by a carrier hydraulic actuator.

Preferably the davit arm comprises an outer davit arm and an inner davit arm, the inner davit arm being arranged inside of the outer davit arm.

Preferably the davit arm further comprises an intermediate davit arm.

Preferably, said carrier is adapted to be suspended from an opening in the lower half of the inner davit arm.

Preferably, the carrier is adapted to be slidably moved from an end position within the inner davit arm to an opposite end position within the inner davit arm.

Preferably, said turntable is adapted to rotate the davit arrangement 360° around a vertical axis extending through the center of the turntable.

Preferably, the hoisting arrangement comprises a winch connected to the carrier and a hoisting wire with a suspending hook.

Preferably, the hoisting arrangement comprises a swivel joint arranged between the hoisting wire and the hook.

Preferably, the davit arrangement comprises a further telescopically displaceable davit arm, carrier and a hoisting arrangement for two points hoisting and lowering of one or more boat or cargo devices.

The invention further relates to a method for transporting a boat of a cargo device using the davit arrangement, the method comprises the steps of:

a) moving the carrier together with the telescopic davit arm to an extended position being an outreach storage or launching position for hoisting or lowering a boat or cargo device, b) moving the carrier together with the telescopic davit arm to a retracted position being an in-reach position.

The in-reach position being a position where the boat or cargo is arranged in the center position (A) of the turntable.

Preferably, the method further comprises c) rotation of the davit arrangement to position the davit arm in a position for opposite movement of the boat or cargo device than the hoisting or lowering in step a), d) moving the carrier together the telescopic davit to an extended position being outreach launching or storage position for opposite movement of the boat or cargo device than the hoisting or lowering in step a).

The positioning in c) may be different angles within the 360° circle of the turntable. One possible angle being for instance 180°, i.e. lateral opposite positions for the launching and the storage of the boat or cargo.

The invention further relates to a davit arrangement system comprising a suspension arrangement and the davit arrangement according to the invention, the davit arrangement being suspended from the suspension arrangement.

Preferably, wherein the suspension arrangement comprises a set of rails adapted to be arranged spaced apart on a roof or other overhanging construction in a distance for receiving the davit arrangement, the davit arrangement is adapted to be slidingly arranged in the suspension arrangement.

Further features and objects of the invention will become apparent from the subsequent description with reference to the enclosed drawings

DETAILED DESCRIPTION OF THE INVENTION

Figure 1:
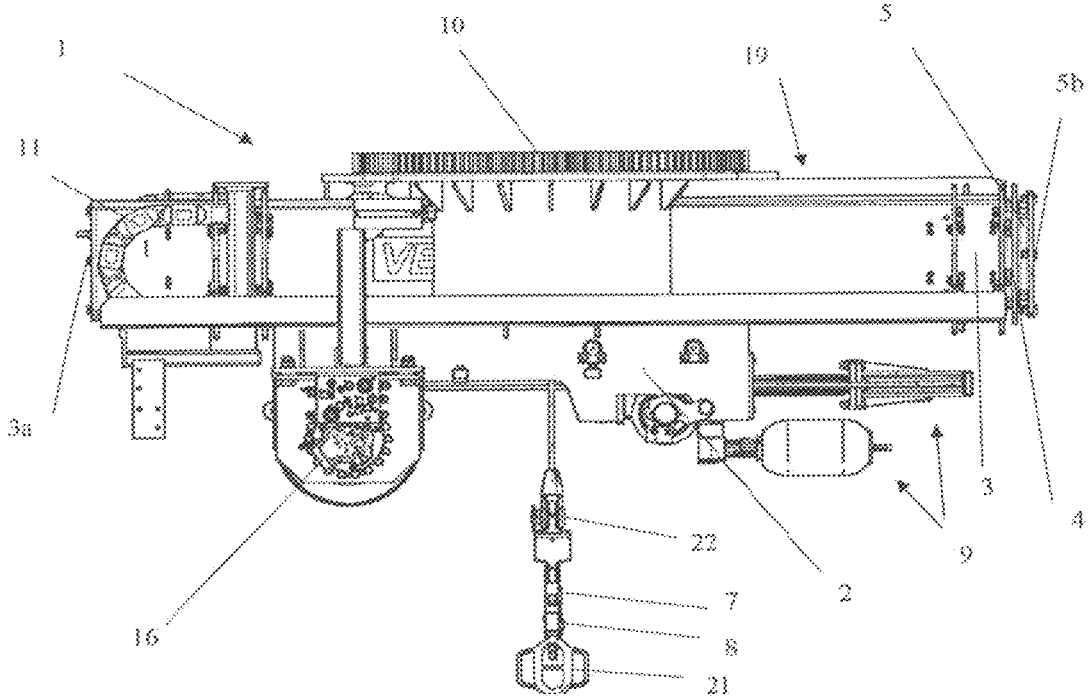
FIG. 1-2 shows the davit arrangement according to the invention in the innermost position, viewed from the side.

There is defined three operational positions throughout the description.

The term "storage area" defined as the area where the boats or cargo are stored or initially placed, in a rest position.

The term "launching area" is defined as the area where the boat or cargo is intended to be position when moved from the "storage" by the davit arrangement. For a boat the launching area is this is normally the sea surface, for a cargo, the launching area may for instance be a deck space or similar surface for further transport by vessel, trailer etc.

The term "outreach launching position" is defined as the position when a carrier with hoisting arrangement has been moved to an outermost position. This position may be above a launching area to hoist the boat or cargo up or down from/to this area.

An "outreach storage position" is defined as the position where the carrier is moved to an outermost position to store a boat or cargo in a storage area in connection with the davit arrangement, alternatively lift a boat of cargo from the storage area.

An "in-reach position" is defined as an intermediate position between the two previous defined positions, before/after the launching and storage of the boats or cargo. The carrier is in this position arranged in the innermost position of the davit arrangement. This position being a position where the hoisting arrangement is in a aligned with a center axis of the turntable.

The term "boat" is defined as any boat or similar devices adapted to be launch or parked by the davit arrangement. This may for instance be a lifeboat, or other similar boats that is suitable to be operated by the davit arrangement. The term "boat" also includes unmanned surface vehicle (USV), unmanned and manned autonomous underwater vehicle (AUV) and cargo.

The term "cargo" is defined as any container or similar devices suitable to be moved by the davit arrangement to/from a storage area from/to a launching area.

The term "telescopic arrangement" refers to an arrangement that is extendable and retractable by slidingly moving inner and intermediate parts in respect to each other and an outer part. The features will be described in detail below.

The term "one-point davit arrangement" refers to an arrangement having one contact point to the boat for the launching/hoisting operation, i.e. it comprises one telescopic arrangement. For simplicity, a single telescopic arrangement is referred to as a one-point davit arrangement hereinafter in the description.

The term "two points davit arrangement" refers to an arrangement having two contact points to the boat for the launching/hoisting operation, i.e. it comprises two individually or correlatedly operated telescopic arrangements. Each of the individually telescopic arrangements may have the same design as the one-point davit arrangement. The following description refers to the arrangement with combined two telescopic arrangements as "the two-points davit arrangement".

FIG. 1-9 illustrates a davit arrangement 1 according to an embodiment of the invention in an in-reach position.

Figure 2:
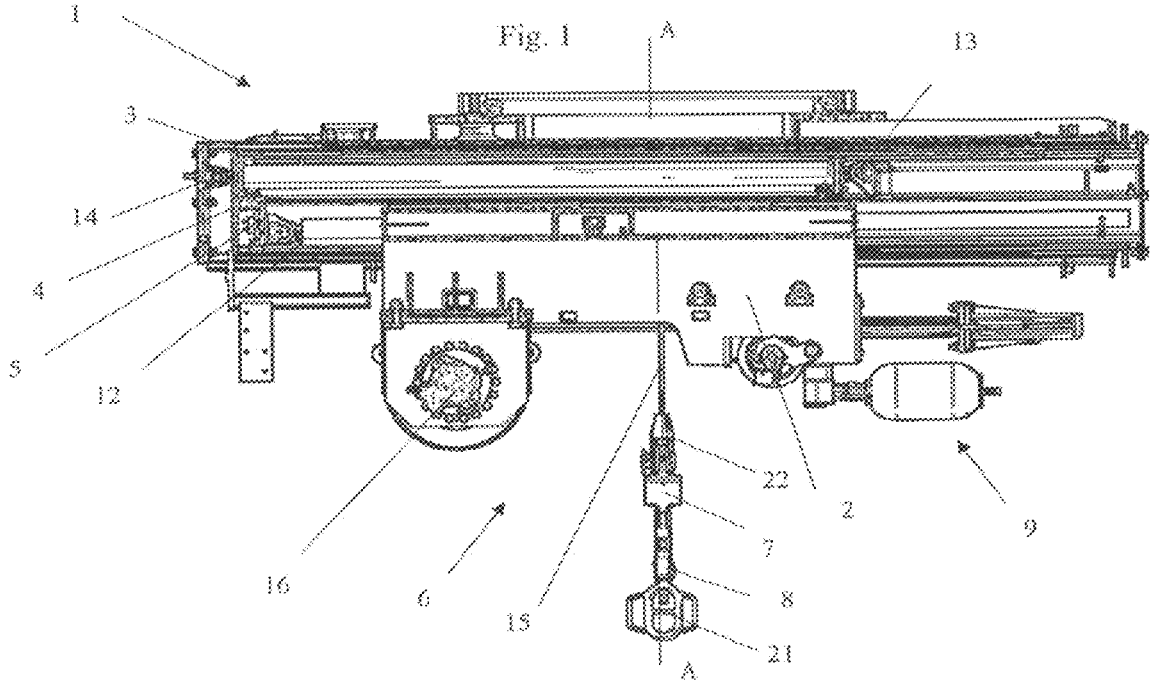

FIG. 1-2 illustrates the davit arrangement 1, viewed from the side. FIG. 2 is a cross-sectional view showing interior parts of the davit arrangement.

The davit arrangement 1 comprises a davit housing 19 and a carrier 2 slidable arranged in the davit housing 19. The davit housing 19 further comprises an outer davit arm 3, an inner intermediate davit arm 4 and an inner davit arm 5. The davit arms 3, 4, 5 are arranged telescopically as indicated in the figure. The outer davit arm 3 is shown as the outer surface of the housing 19, and thus formed as an integrated part of the housing 19. The collective term of the inner, intermediate, and outer davit arms is named telescopic davit arm 3, 4, 5. It is to be noted that the telescopic davit arm 3, 4, 5 may comprise only the inner and outer davit arm 3, 5. There may also be several inner intermediate davit arms 4. The invention is thus not restricted to three davit arm parts 3, 4, 5.

The davit arrangement 1 has further a hoisting arrangement 6 suspended from the davit arrangement 1. The davit arrangement 1 may further have a shock absorber 9 and a hydraulic tube guideway 11 as illustrated in the figure. In addition, the davit arrangement comprises a turntable 10 for connection with a roof or other overhanging structure.

The hoisting arrangement 6 may further comprise a winch 16. The winch 16 is fixedly attached to the carrier 2. The hoisting arrangement 6 may further comprise a hoisting wire 15, a spelter socket 22, a hook 8 and a lifting ring 21. This is per se known. The hoisting arrangement 6 may further comprise a swivel joint 7. The swivel joint 7 may be positioned between the hook 8 and the hoisting wire 15 to allow rotational movement of the hook 8 relative the hoisting wire 15.

The shock absorber 9 is further attached to the carrier 2. The shock absorber 9 may be a tension type shock absorber and is known per se.

The hydraulic tube guideway 11 is intended to support hydraulic tubes that supplies hydraulic oil to various part of the system and make sure that the tubes do not come into contact/or be damaged by the moving parts.

The turntable 10 is disclosed at the top part of the davit arrangement 1. The turntable 10 is connected to the housing 19. The turntable 10 is further connected to a roof or other overhanging construction (not shown). The turntable 10 is arranged so that the davit arrangement 1 may rotate 360° with respect to the roof or overhanging construction to position the extendable parts of the davit arrangement.

FIG. 2 is a cross-sectional view showing interior parts of the davit arrangement. The figure shows in detail the interior of the davit arrangement 1.

The inner intermediate davit arm 4 is slidably arranged within the outer davit arm 3. The inner intermediate davit arm 4 is moved by a first cylinder piston arrangement, hereinafter called a first hydraulic actuator 14 where one end of the first hydraulic actuator 14 is attached to the outer davit arm 3 and the other end is attached to the inner intermediate davit arm 4. This provides a slidingly movement of the inner intermediate davit arm 4 along the longitudinal direction of the outer davit arm 3.

Likewise, the inner davit arm 5 is slidably arranged within the inner intermediate davit arm 4. The inner davit arm 5 is moved by a second cylinder piston 13, hereinafter called a second hydraulic actuator 13 where one end of the second hydraulic actuator 13 is attached to the inner intermediate davit arm 4 and the other end is attached to the inner davit arm 5. This provides a slidingly movement of the inner davit arm 5 along the longitudinal direction of the inner intermediate davit arm 4.

The davit arrangement 1 further comprises a third piston cylinder 12, hereinafter called carrier hydraulic actuator 12. The carrier hydraulic actuator 12 is arranged between the inner davit arm 5 and the carrier 2 as indicated in the figure. This means that one end of the carrier hydraulic actuator is attached to the inner davit arm 5 (at an end point 5*a*) and the other end is connected to the carrier 2 to provide a slidingly movement of the carrier 2 with respect to the inner davit arm 5.

In the in-reach position as shown in the FIGS. 1-9, the first, second and carrier hydraulic actuator 14, 13, 12 are in a retracted innermost position. The inner intermediate davit arm 4, the inner davit arm 5 and the outer davit arm 3 is consequently arranged in the retracted innermost position.

The hook 8 is in this position extending vertically along a centerline A of the turntable 10 as indicated in the FIG. 2. This means that the hoisted wire 15 and/or hook 8 will rotate around its own axis when the davit arrangement 1 is rotated by the turntable 10.

FIG. 3-9 illustrates the davit arrangement in the in-reach position from various positions. None of these figures however shows the hydraulic actuators that are arranged within the davit arrangement 1.

Figure 4:
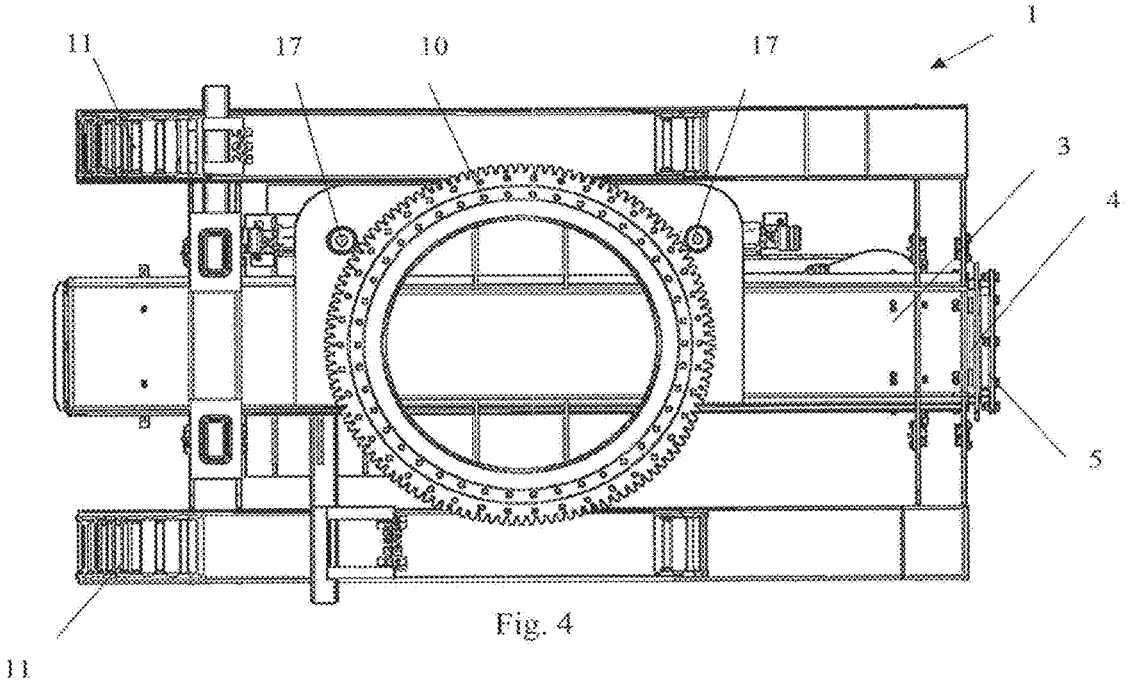
FIG. 4 shows the davit arrangement according to the invention in the innermost position, viewed from above.
Figure 5:
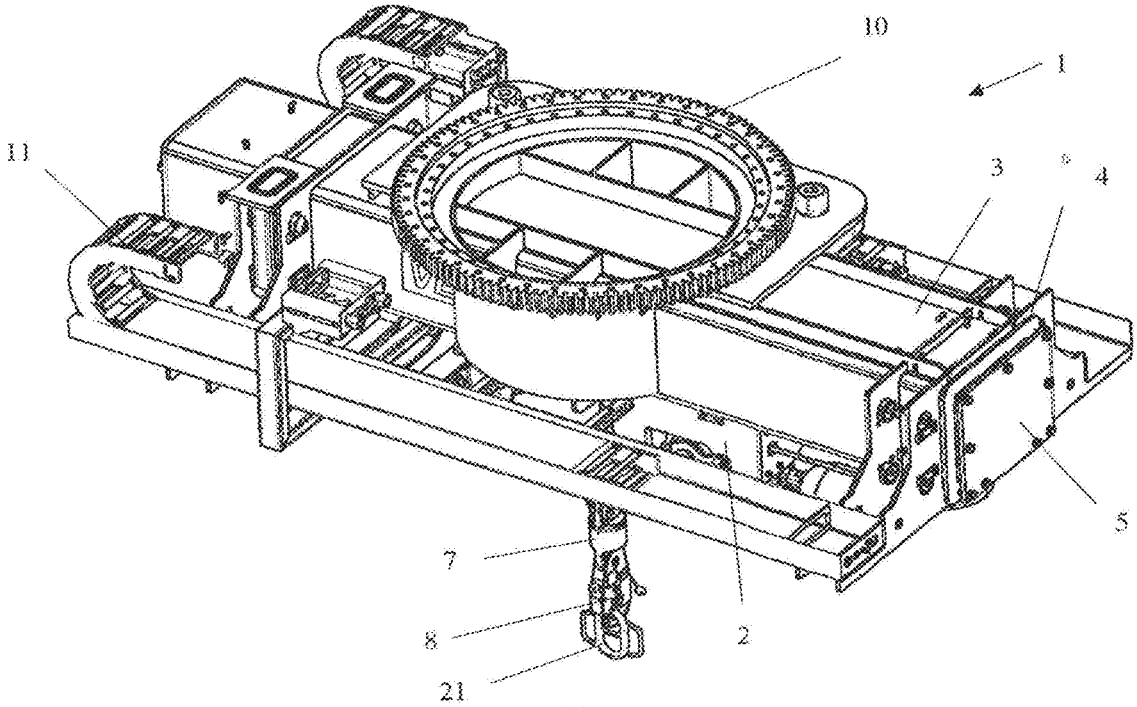
FIG. 5-7 shows the davit arrangement according to the invention in the innermost position, perspective viewed from above from various angles.

FIG. 4 illustrates the davit arrangement 1 from above and illustrates how the turntable 10 is in connection with toothed gear wheel(s) or pinion 17 to facilitate the rotational movement. The turntable 10 has two circular rings that is slidably connected. The circular rings are concentrically arranged with the center axis A as the common center.

The outer ring is connected to the roof or other overhanging structure, while the inner ring is attached to the davit housing 19. The pinion 17 is in contact with the outer ring to provide the rotational movement of the davit arrangement 1, 20. A turntable is as such known per se.

Figure 6:
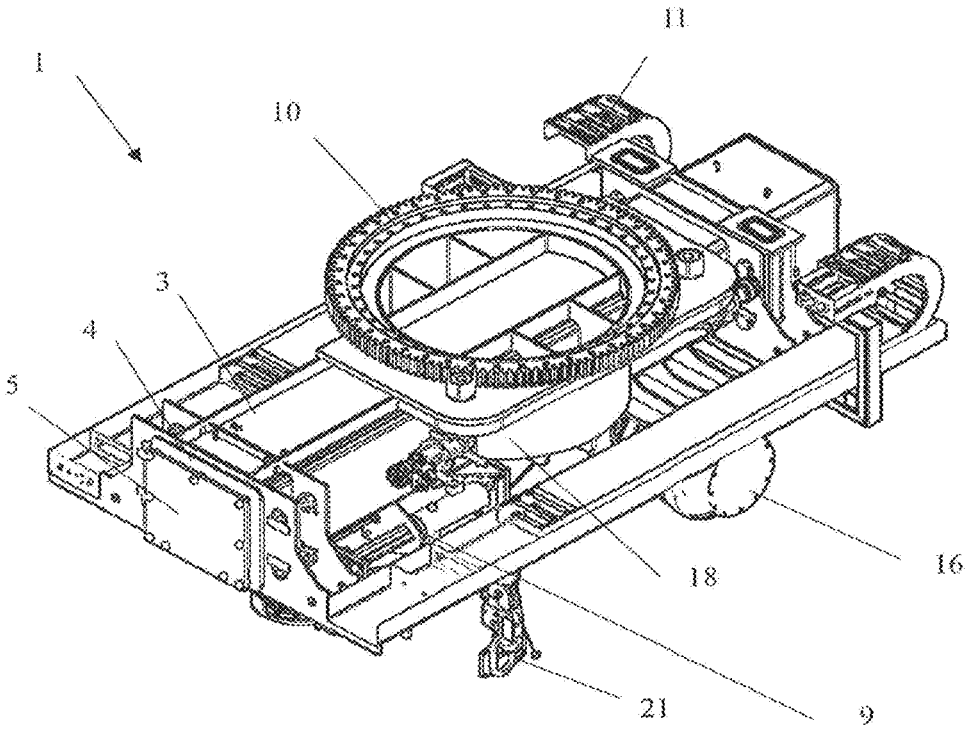
Figure 7:
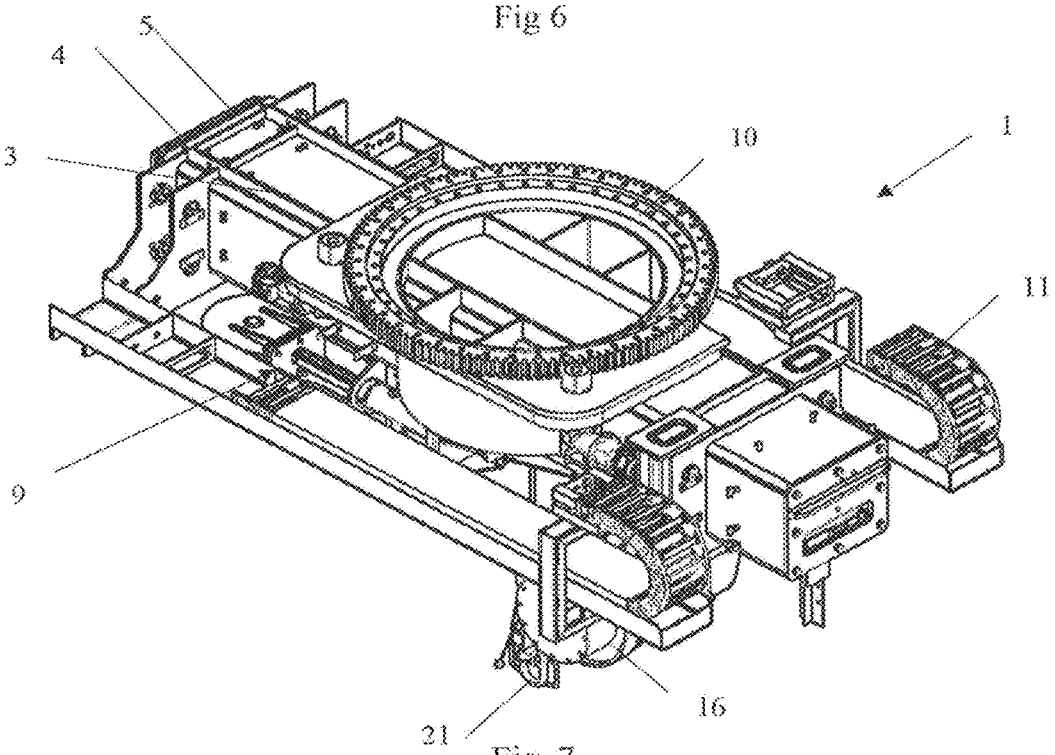
Figure 8:
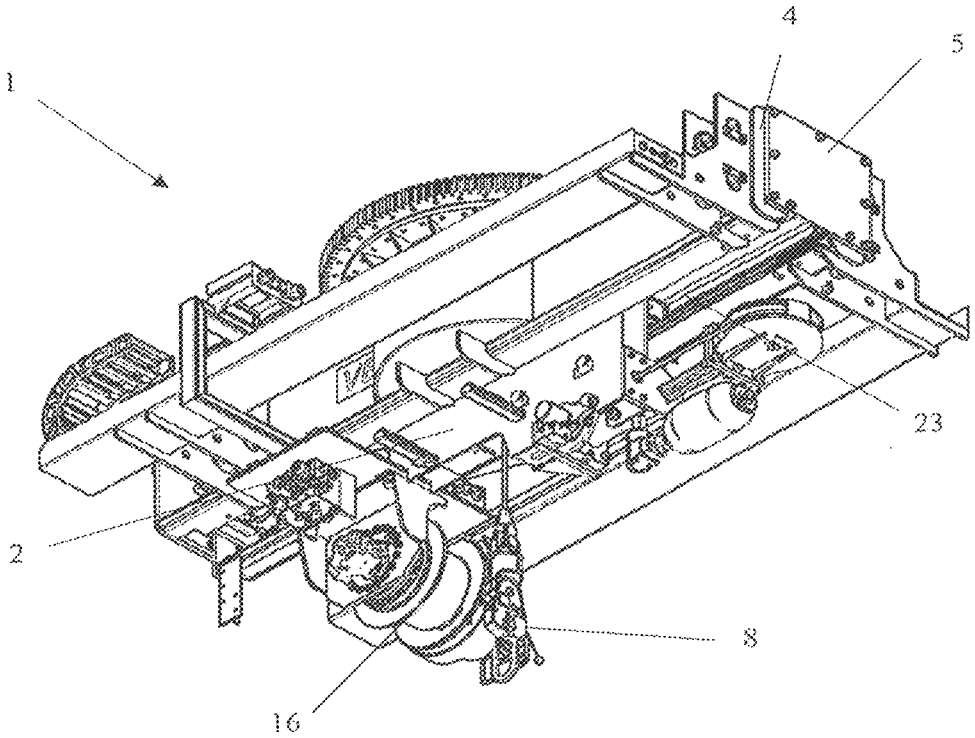
FIG. 8-9 shows the davit arrangement according to the invention in the innermost position, perspective viewed from below from various angles.
Figure 9:
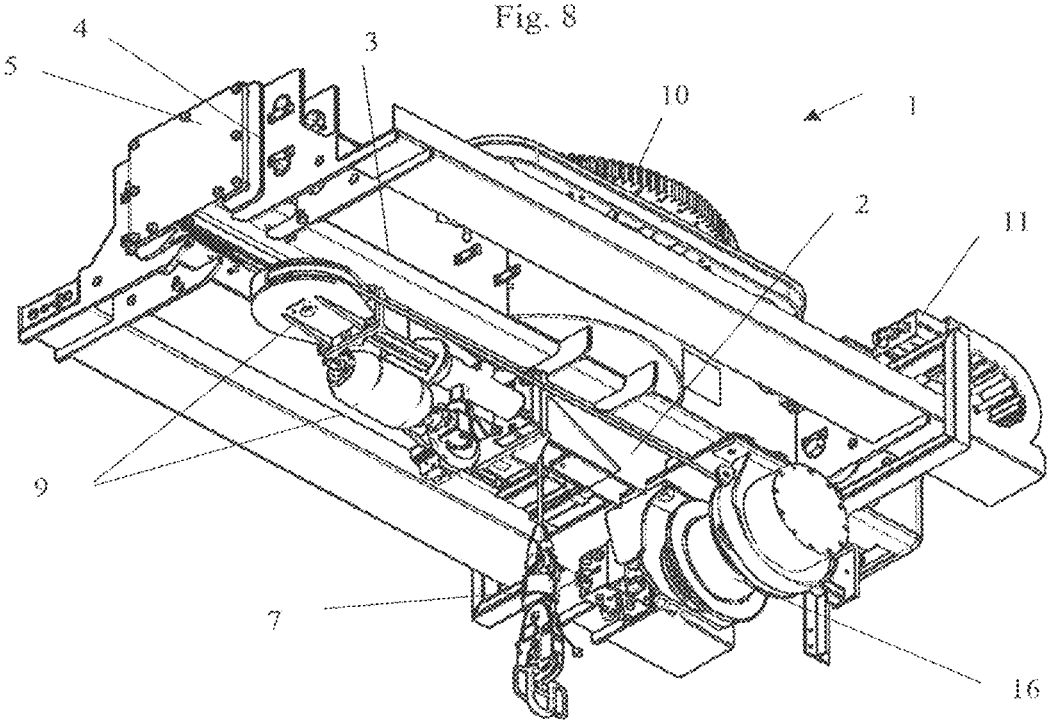

FIG. 5-9 further shows the davit arrangement in the in-reach position in different perspective view from above and from below. FIG. 6 illustrates a motor 18 to power the rotational movement of the turntable 10.

FIG. 10-14 illustrates the davit arrangement according to the embodiment from FIG. 1-9 in an outreach position. This position both refers to the outreach storage position and the outreach launching position, as the only difference in the two positions are the way the davit arms 4, 5 extends.

Figure 10:
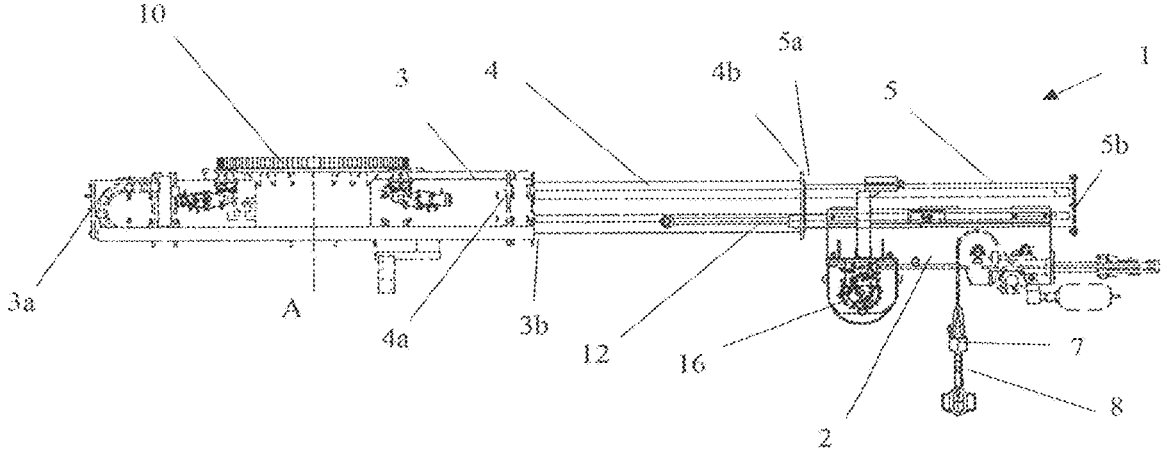
FIG. 10 shows the davit arrangement according to the invention in the outermost position, viewed from the side.

FIG. 10 illustrates the outreach position viewed from the side. The inner intermediate davit arm 4 and the inner davit arm 5 are in this position extended to the outermost position.

In addition, the carrier is 2 moved to an outermost position in the inner davit arm 5. This can be shown in the FIG. 10 where the carrier hydraulic actuator 12 is extended. The carrier 2 is thus moved from an end point 5*a* (FIG. 11) of the inner davit arm 5 towards an opposite end 5*b* of the inner davit arm 5. The davit arm 5*b* is the free end extending out of the davit arrangement as shown in the FIG. 10.

Figure 11:
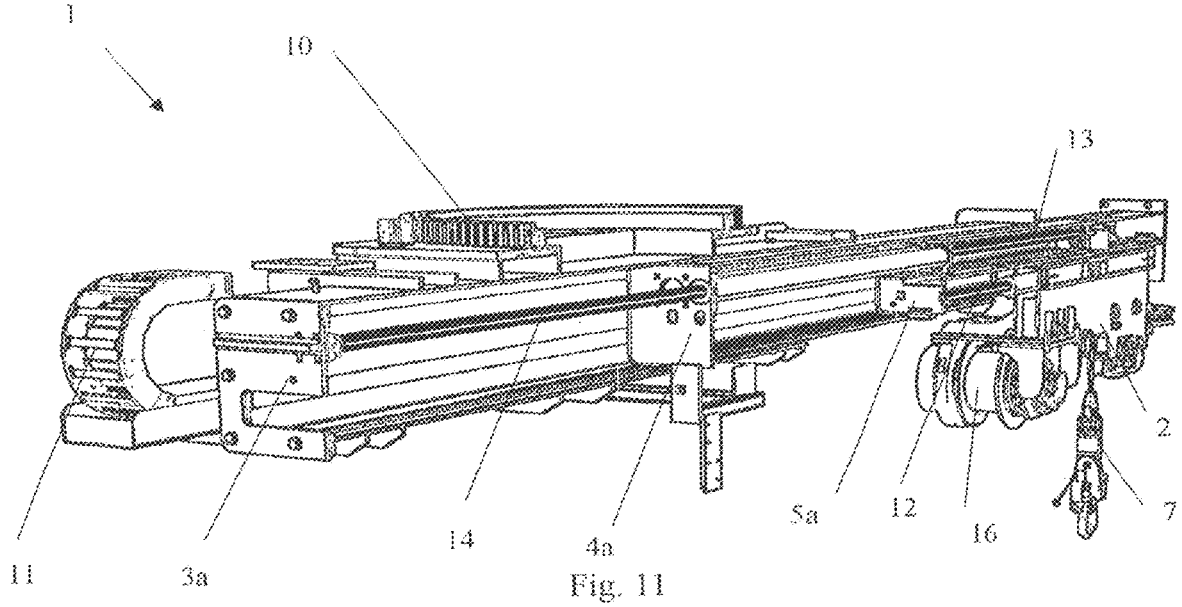
FIG. 11-14 shows the davit arrangement according to the invention in the outermost position, perspective viewed from various angles.
Figure 12:
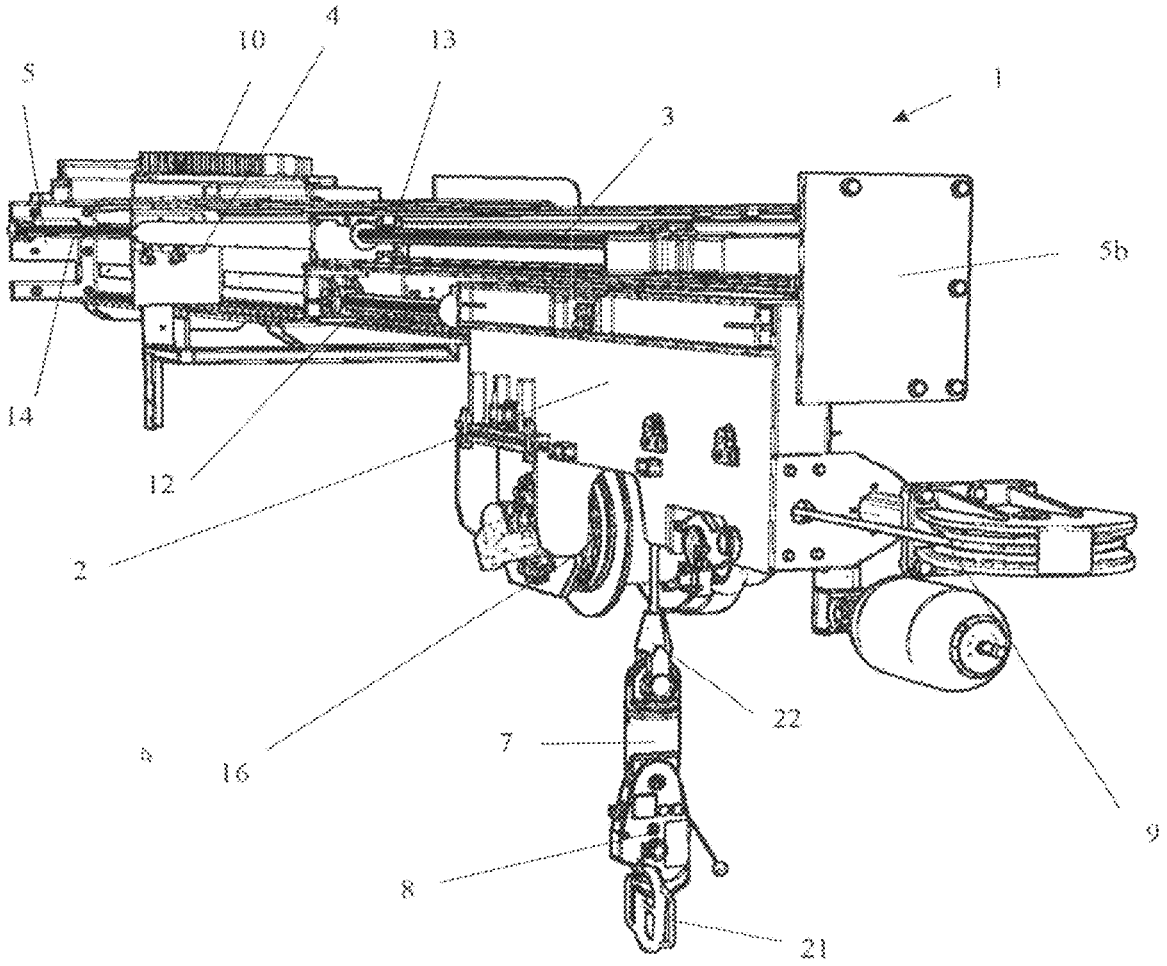

FIG. 11-12 illustrates the davit arrangement in the outreach position, perspective view. The figures are also cross-sectional view to illustrate in greater detail the first, second and carrier hydraulic actuators 14, 13, 12 and their extended position to extend the davit arms 3, 4, 5 telescopically and in addition move the carrier 2 towards the free end of the inner davit arm 5*b*.

FIG. 11 illustrates further the end point 4*a*, 5*a* of the intermediate and inner davit arm 5 arranged respectively within the outer davit arm 3 and the inner intermediate davit arm 4. The figure also illustrates the end point 3*a* which is an integrated part of the housing 19.

Figure 13:
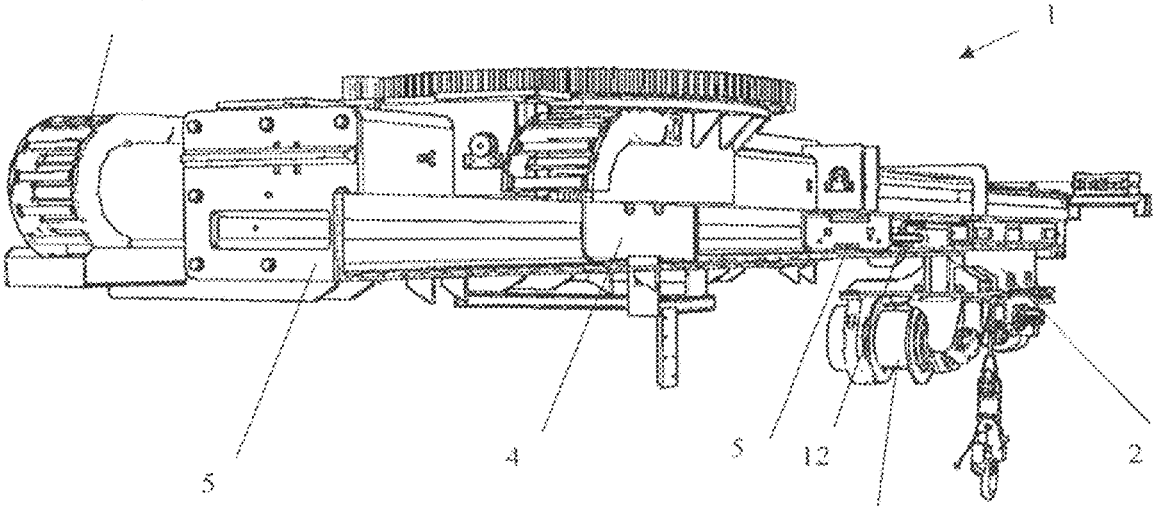
Figure 14:
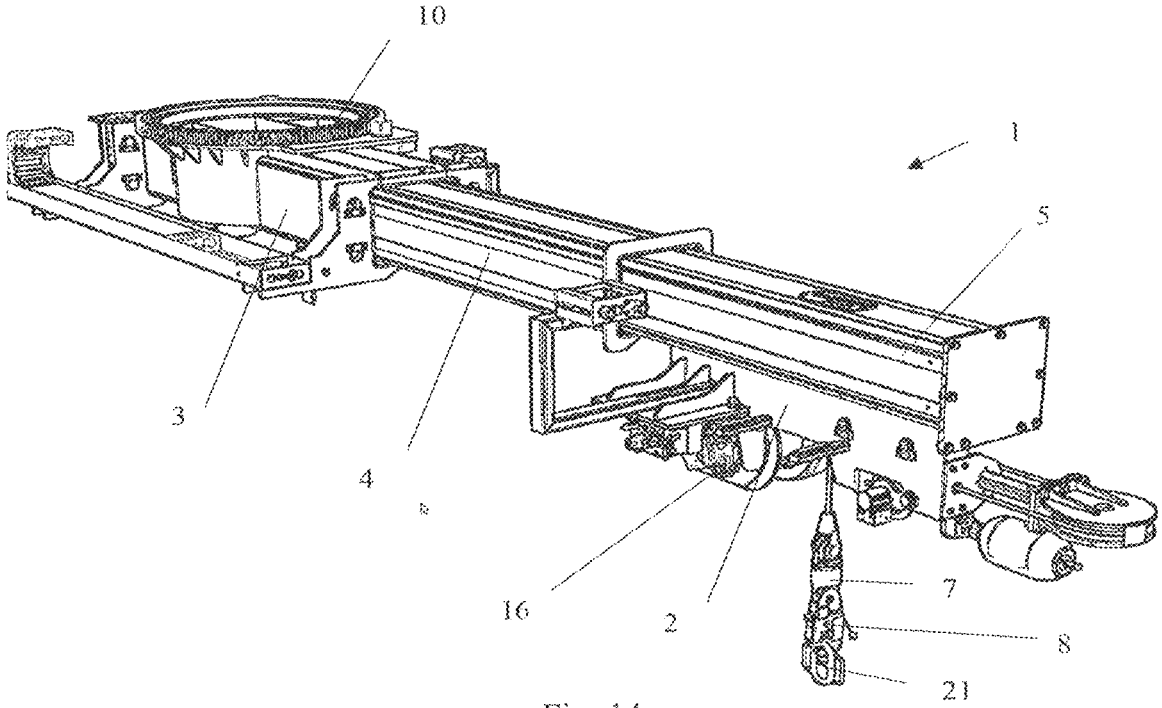

FIGS. 13 and 14 illustrates the same perspective view of the outreach position as FIGS. 11 and 12. However in these illustrations, the first and second hydraulic actuators 14, 13 are not shown, only the carrier hydraulic actuator 12 between the inner davit arm 5 and the carrier 2 is indicated in FIG. 13.

Figure 15A:
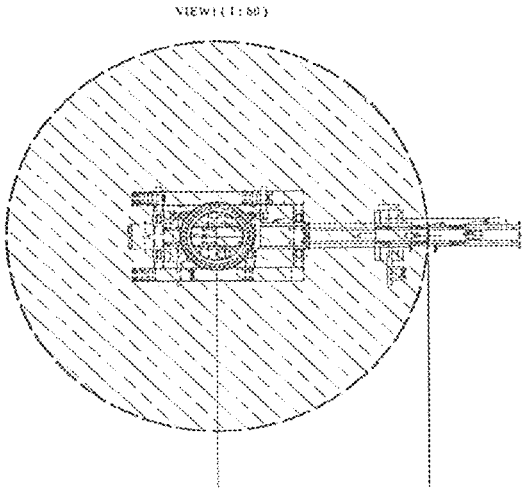
FIG. 15*a* shows the maximum innermost position and outermost position of a davit arrangement according to a prior art davit arrangement.
Figure 15B:
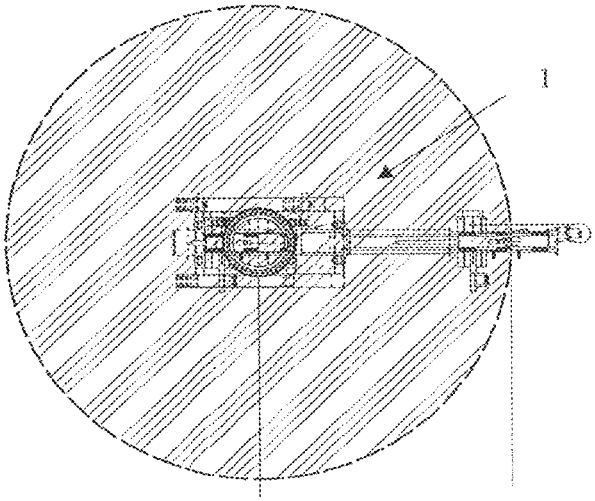
FIG. 15*b* shows the innermost and outermost position of the davit arrangement according to the invention.

FIG. 15*a* illustrates the possible outreach of a prior art davit arrangement FIG. 15*b* illustrates the possible outreach for the davit arrangement according to the invention. The respective circle of 15*a* and 15*b* illustrates the position of the hook in the outermost position for the prior art davit arrangement and the davit arrangement according to the invention.

As illustrated in the FIG. 15*a*-15*b*, the prior art davit arrangement has a narrower operational diameter than the invention. This is due to the possibility for the carrier 2 of the davit arrangement according to the invention to move independently within the davit arm 3, 4, 5. This would thus result in the outreach position i.e. when the davit arms 3, 4, 5 are extended in the outermost position as indicated in the FIG. 11-14, the carrier 2 may at the same time be moved along the inner davit arm 5 from a position within close to the point end 5*a* of the inner davit arm 5 to the opposite free end 5*b* of the davit arm 5. The winch 16 and hook 8 are connected to the carrier 2 and thus moved outwardly together with the carrier 2.

Optionally a prior art davit arrangement may have a hook that is arranged at the free end of the davit arm. However, this would result in a davit arrangement where the hook and lifting ring is unable to be positioned at the center position at the center of the turntable 10.

The presently invention thus fulfills both criteria by the same davit arrangement. Both a fully in-reach position at the center of the davit arrangement and a fully outreach position where the hook may extend to a greater distance away from the center. This will further relate to a greater rotational circle.

Figure 16A:
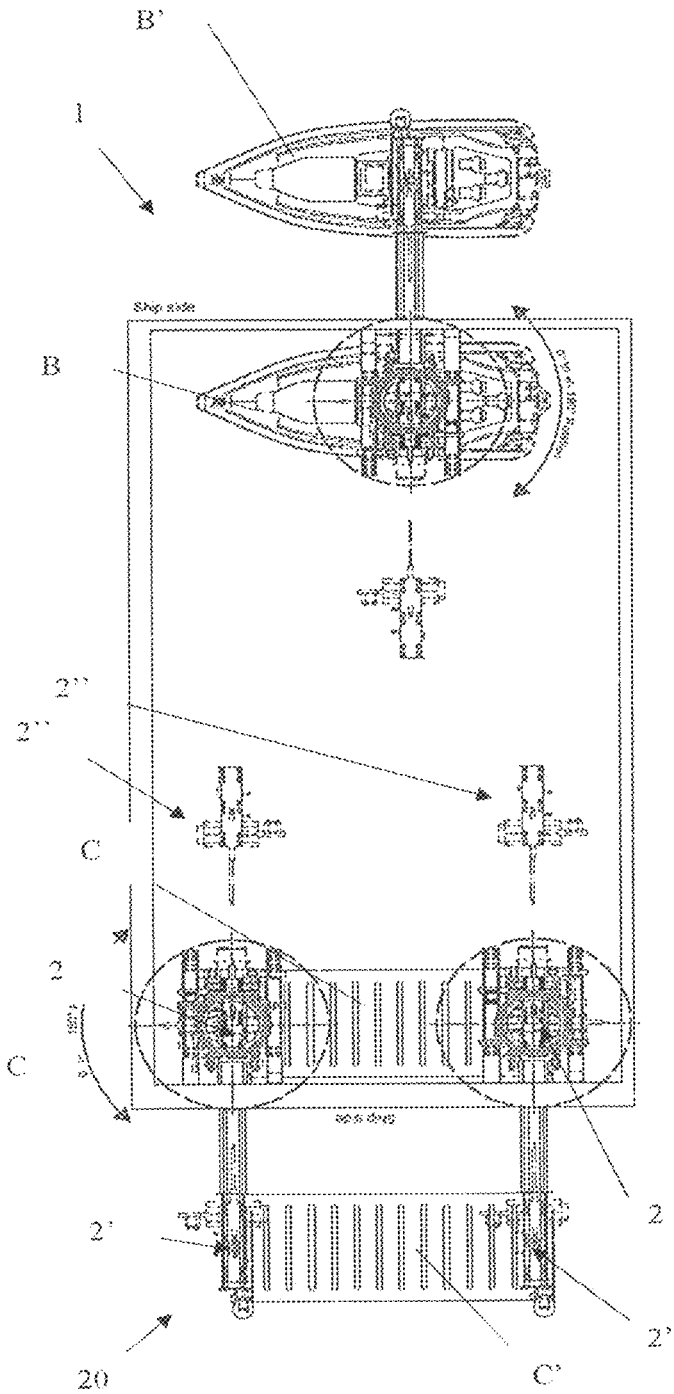
FIGS. 16*a* and 16*b* illustrates the functioning of the davit arrangement for storing or deploying a boat or a cargo.
Figure 16B:
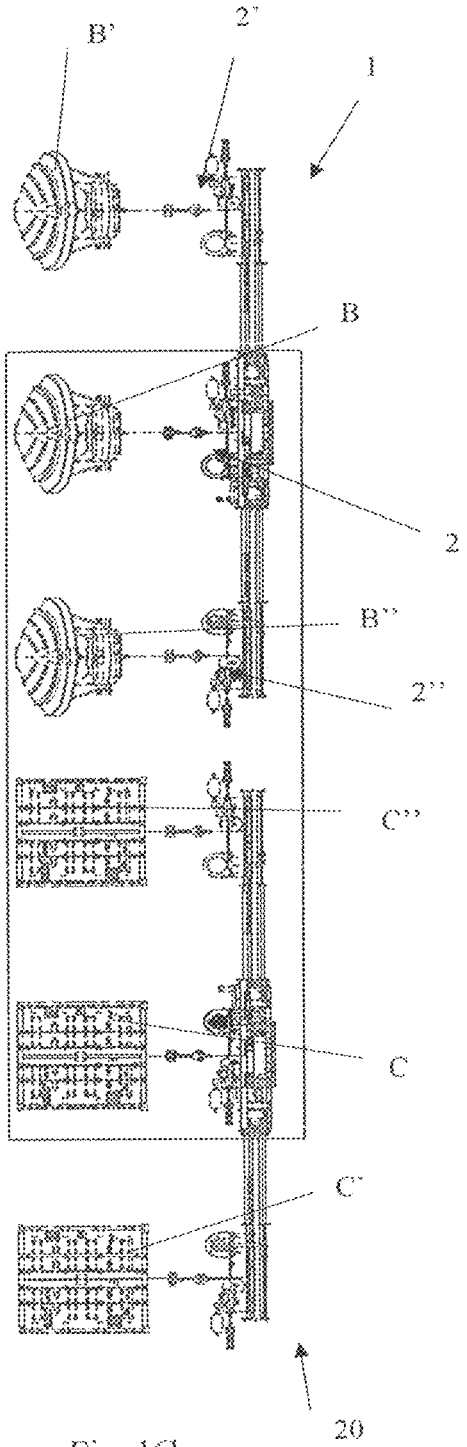

The FIG. 16*a* and FIG. 16*b* further illustrates the functioning of the invention. FIGS. 16*a* and 16*b* illustrates the davit arrangement 1 according to the above-described invention with one davit device. This is illustrated by a boat B that is suspended from the hook 8 and lifting ring 21 in a single point. The figure further illustrates a davit arrangement 20 having two davit devices suspending a cargo C in a two-point suspension. It is to be noted that the suspended devices constitute only examples. A boat may be suspended in a two-point suspension and a cargo C may be suspended in a single point suspension. FIG. 16*a* shows the davit arrangement 1, 20 viewed from above.

FIG. 16*b* shows the corresponding davit arrangement 1, 20 viewed from behind/in front, i.e. the direction perpendicularly of the travelling distance of the davit arrangement 1, 20.

The figure illustrates the three main positions; in-reach position where the boat B or cargo C is arranged in a center position A. This position is represented by the reference number B, C and 2 for the respective boat, cargo and carrier 2.

To illustrate and distinguish the outreach launching position from the other positions, the reference number B', C' and 2' are used as reference number for the boat, cargo and the carrier 2.

Likewise, to illustrated and distinguish the outreach storage position from the above positions, the reference number b", c" and 2" are used as reference number of the boat, cargo and the carrier 2.

The boat B, the cargo C and the carrier 2 are thus the same features, only positioned in different positions in the figures.

As illustrated in the FIGS. 16*a* and 16*b*, the davit arrangement 1, 20 may move a boat B or cargo C from a launching position to a storage position, via an in-reach position. The boat B' or cargo c' in the launching position is hoisted by the hoisting arrangement 6 to a position elevated from the sea surface or other surface where the boat B or cargo C has been positioned prior/after to the hoisting.

In this position the davit arrangement 1, 20 is in the outreach launching position. This means that the davit arrangement 1, 20 is extended to the outermost position where the davit arms 3, 4, 5 are telescopically extended.

From this position the davit arms 3, 4, 5 are retracted so that the inner and inner intermediate davit arms 4, 5 are retracted within the outer davit arm 3. The carrier 2 with the boat B or cargo C is at the same time moved to a center position A. This is performed by retracting the carrier hydraulic actuator 12, that is arranged between the inner davit arm 3 and the carrier 2. The carrier 2 is suspended through an opening 23 (FIG. 8) in the lower half of the inner davit arm 5. This means that a part of the carrier 2 is arranged at the interior of the inner davit arm 5 and bearing against parts of the bottom part of the inner davit arm in a slidingly manner.

Figure 3:
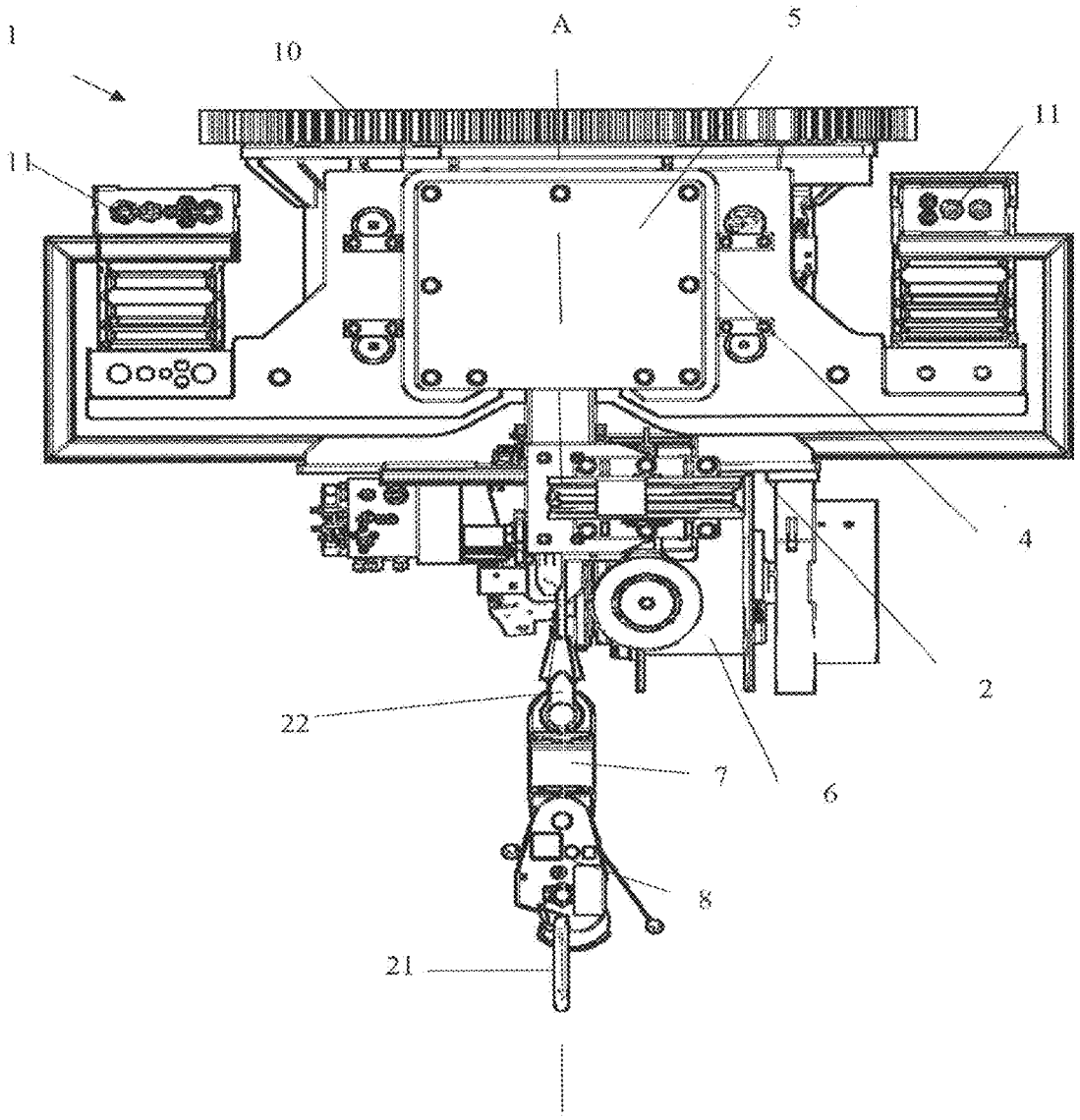
FIG. 3 shows the davit arrangement according to the invention in the innermost position, viewed from behind.

The boat B or cargo C is now positioned in the in-reach position, i.e. the position where the hook 8 and/or lifting ring 21 is arranged in the center A position of the turntable 10 as previously illustrated in FIG. 3.

In this in-reach position, the davit arrangement 1, 20 is able to rotate while the boat B or cargo C maintains in the center position A. This is performed by the turntable 10. To maintain the same positioning of the boat B or cargo C it is preferable to have the swivel joint 7 arranged between the hook 8 and/or lifting ring 21 and the hoisting wire 15. This makes it possible to rotate the swivel joint 7 while keeping the hook with the boat B or cargo C steady.

It is thus possible to rotate the davit arrangement without performing any steps of lowering the boat B or cargo C before rotating the davit arrangement to a position for opposite launching or hoisting.

When the davit arrangement 1, 20 has been rotated 180°, the davit arrangement 1, 20 is arranged diametral opposite and the davit arm 3, 4, 5 is able to extend telescopically in the opposite direction towards an outreach storage position. In this position the boat B or cargo is arranged in a position elevated from a storage position for the boat B or cargo C. The boat B or cargo C may further be lowered into the storage position by the hoisting arrangement 6.

The invention has been described with a rotation of the turntable of 180°. Other operation angles are also possible, for instance −/+90°. The remaining operation of the davit arrangement 1, 20 will be the same as describe above.

The above description relates to a movement of the boat or cargo from the sea surface or other final destinations to the storage position where the boat of cargo is to be stored. However, it is to be understood that the opposite procedure is possible, i.e. the movement of the boat B or cargo C from storage to launching by performing the opposite procedure.

As mentioned above, the davit arrangement 1, 20 may be fixedly attached to the roof or overhanging construction directly through the turntable. In this connection, the davit arrangements only possible movement is a rotational movement provided by the turntable.

There may also be another suspension of the davit arrangement according to the invention. This is illustrated in FIG. 17-21.

Figure 17:
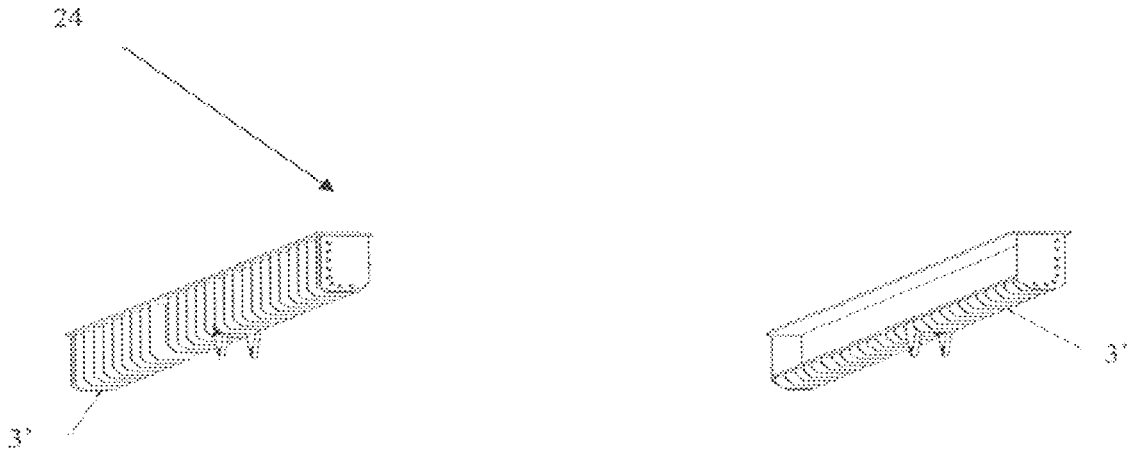
FIG. 17 shows an example of a suspension arrangement for the davit arrangement according to the invention.

FIG. 17 shows a suspension arrangement 24 according to an embodiment of the invention. The suspension arrangement 24 may comprise rails 3' as shown in the figure. The rails 3' are spaced apart and fixedly attached to the roof or the overhanging construction. The rails are equal to the rails 3 described in the Norwegian application 20210184 from the same applicant, to which reference are made. The rails 3' are arranged spaced apart and parallelly, longitudinally arranged.

The rails are arranged so that the davit arrangement 1, 20 according to the invention is adapted to be slidingly arranged within each of the rails 3'. This is illustrated in the FIGS. 18-21.

The figures further illustrates different positions of the boat or cargo devices B, referred to by the reference number B0, B1, B2, B3, B4, B2', B2", B3', B3".

The boat or cargo B may be positioned in numerous positions by the davit arrangement 1, 20 that is suspended in the suspension arrangement 24.

Figure 18:
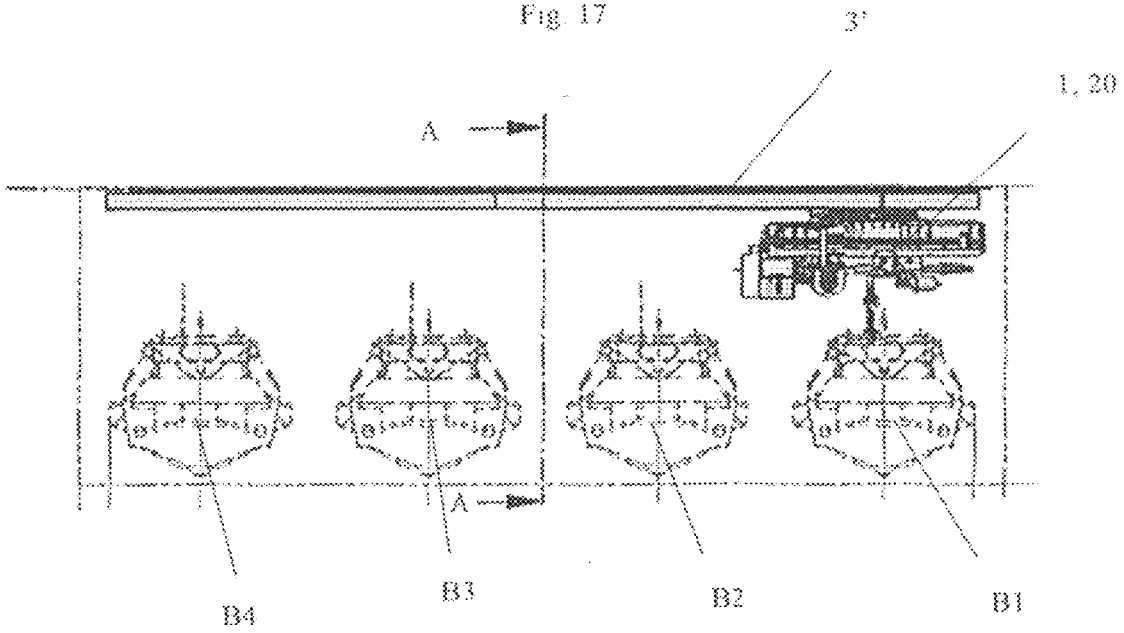
FIG. 18-21 shows the davit arrangement suspended in the suspension arrangement and further illustrated in different operational positions.
Figure 19:
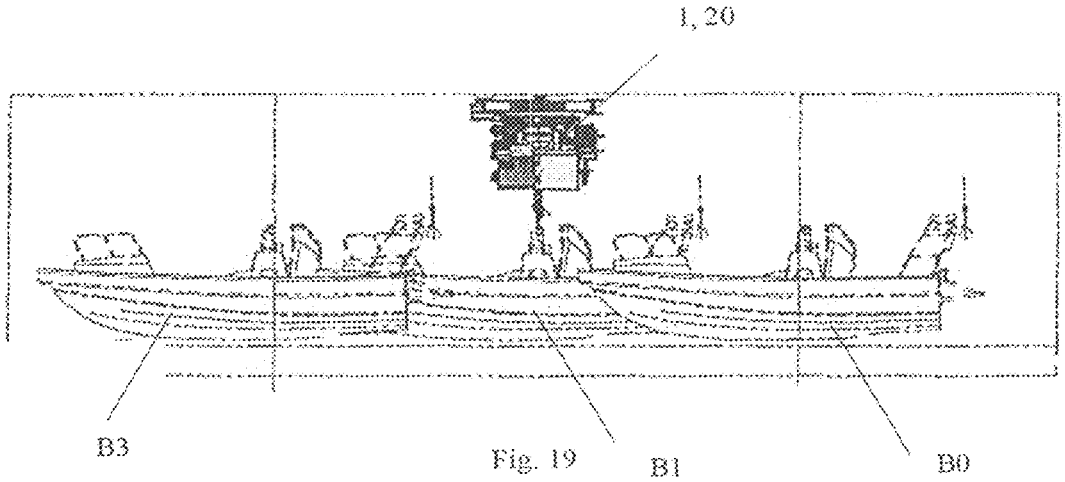
Figure 20:
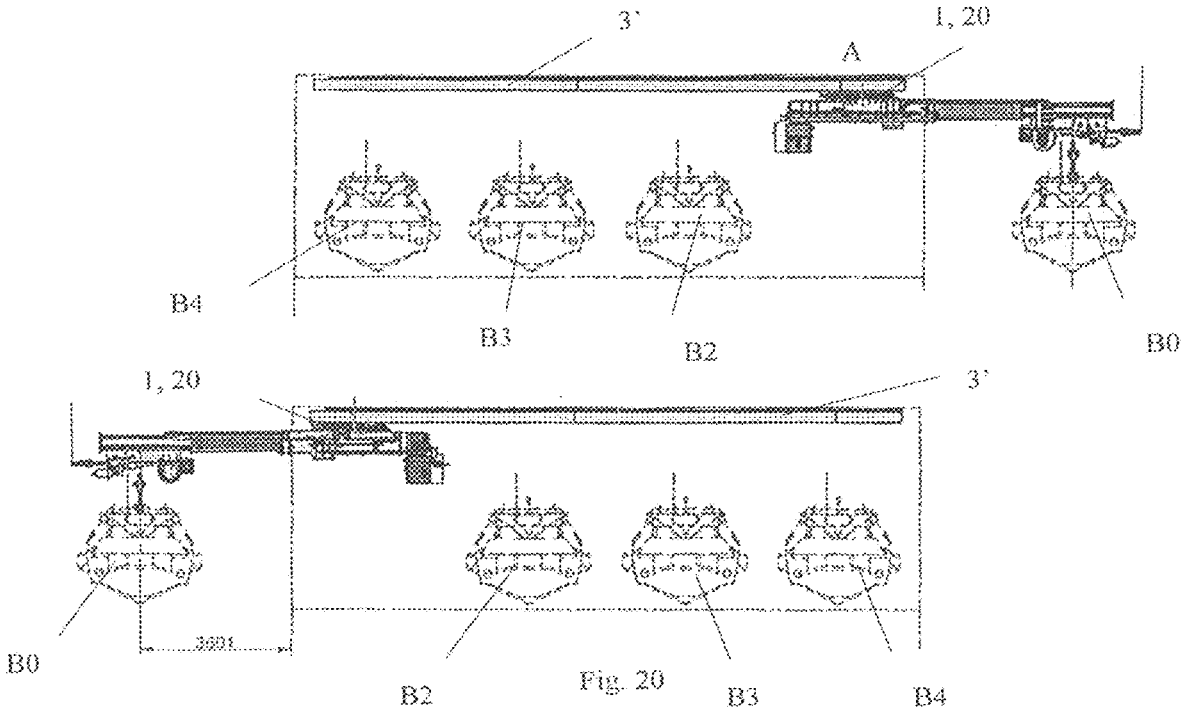

As indicated, the davit arrangement 1, 20 may slide along the suspension arrangement 24 to be positioned in various positions. This will result in that the boat or cargo B may be positioned in various positions along the suspension arrangement 24. This principle is illustrated in FIG. 18-20.

Figure 21:
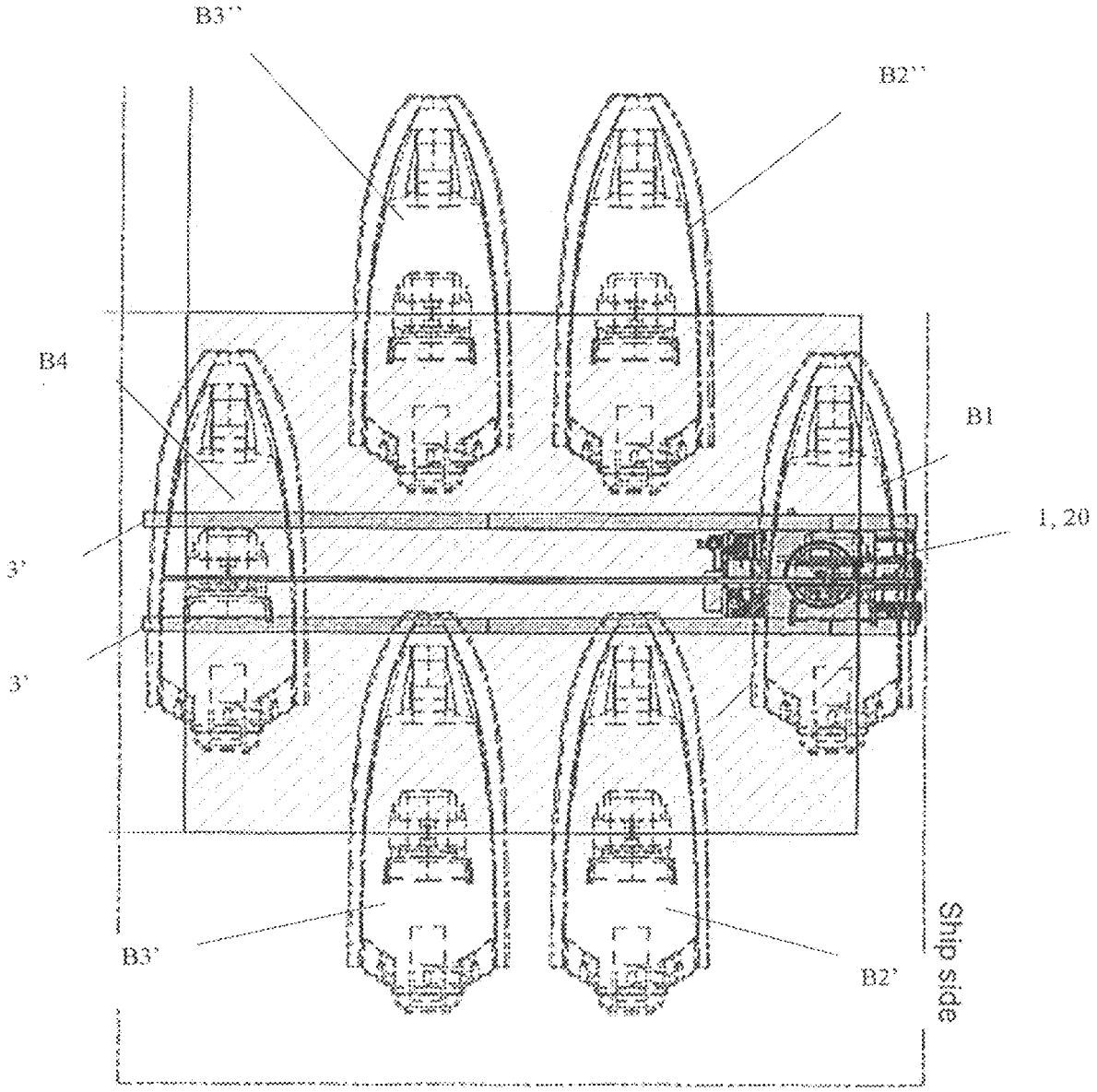

In addition, the turntable 10 of the davit arrangement 1, 20 makes it possible to reach positions outside of the area of the suspension arrangement 24. This is illustrated in FIG. 21 by the reference numbers B2', B3', B2" and B3".

FIGURE LIST

1—davit arrangement, with one suspension point,
2—carrier,
3—outer davit arm,
3*a*, 3*b*—end points of the outer davit arm,

4—inner intermediate davit arm,
4*a*, 4*b*—end points of the inner intermediate davit arm,
5—inner davit arm,
5*a*, 5*b*—end points of the inner davit arm,
6—hoisting arrangement,
7—Swivel joint,
8—hook,
9—shock absorber,
10—turntable,
11—hydraulic tube guideways,
12—carrier hydraulic actuator,
13—second hydraulic actuator,
14—first hydraulic actuator,
15—hoisting wire,
16—winch,
17—toothed gear wheel or pinion,
18—motor,
19—housing,
20—davit arrangement with two suspension point,
21—lifting ring,
22—spelter socket,
23—opening,
24—suspension arrangement,
3'—rail,
A—centerline,
B—boat,
C—cargo.

The invention claimed is:

1. A davit arrangement for arrangement suspended over one or more boats or cargo devices onboard a ship or similar vessel for launching or storing the one or more boats or cargo devices, the davit arrangement comprising:

a davit housing having a telescopically displaceable davit arm and a hoisting arrangement for hoisting and lowering the one or more boats or cargo devices; and a carrier slidably connected to the telescopically displaceable davit arm, the hoisting arrangement being further connected to the carrier, the davit housing connected to a turntable for rotational movement of the davit arrangement around a center axis, the carrier adapted to be retracted to an innermost position where the hoisting arrangement is aligned with the center axis of the turntable.

2. The davit arrangement according to claim 1, wherein the carrier is adapted to be slidably moved by a carrier hydraulic actuator.

3. The davit arrangement according to claim 1, wherein the telescopically displaceable davit arm comprises an outer davit arm and an inner davit arm, the inner davit arm being arranged inside of the outer davit arm.

4. The davit arrangement according to claim 3, wherein the telescopically displaceable davit arm comprises an intermediate davit arm.

5. The davit arrangement according to claim 3, wherein the carrier is adapted to be suspended from an opening in a lower half of the inner davit arm.

6. The davit arrangement according to claim 3, wherein the carrier is adapted to be slidably moved from an end position within the inner davit arm to an opposite end position within the inner davit arm.

7. The davit arrangement according to claim 6, wherein the turntable is adapted to rotate the davit arrangement 360° around a vertical axis extending through a center of the turntable.

8. The davit arrangement according to claim 1, wherein the hoisting arrangement comprises a winch connected to the carrier and a hoisting wire with a suspending hook.

9. The davit arrangement according to claim 8, wherein the hoisting arrangement comprises a swivel joint arranged between the hoisting wire and the suspending hook.

10. The davit arrangement according to claim 1 comprising a further telescopically displaceable davit arm, carrier and a hoisting arrangement for two points hoisting and lowering of one or more boat or cargo devices.

11. A method for transporting a boat or a cargo device using the davit arrangement according to claim 1, the method comprising:

a) moving the carrier together with the telescopically displaceable davit arm to an extended position being an outreach storage or launching position for hoisting or lowering a boat or cargo device; and b) moving the carrier together with the telescopically displaceable davit arm to a retracted position being an in-reach position.

12. The method according to claim 11, the method comprising:

c) rotating the davit arrangement to position the telescopically displaceable davit arm in a position for opposite movement of the one or more boats or cargo devices than the hoisting or lowering in step a); and d) moving the carrier together with the telescopic telescopically displaceable davit arm to an extended position being outreach launching or storage position for opposite movement of the one or more boats or cargo devices than the hoisting or lowering in step a).

13. A davit arrangement system comprising a suspension arrangement and the davit arrangement according to claim 1, the davit arrangement being suspended from the suspension arrangement.

14. The davit arrangement system according to claim 13, wherein the suspension arrangement comprises a set of rails adapted to be arranged spaced apart on a roof or other overhanging construction in a distance for receiving the davit arrangement, the davit arrangement is adapted to be slidingly arranged in the suspension arrangement.

* * * * *